United States Patent [19]

Gunter

[11] Patent Number: 4,801,290

[45] Date of Patent: Jan. 31, 1989

[54] ANGULAR CAP FOR CENTRIFUGES

[75] Inventor: Eberle Gunter, Tuttlingen, Fed. Rep. of Germany

[73] Assignee: Firma Andreas Hettich, Tuttlingen, Fed. Rep. of Germany

[21] Appl. No.: 152,829

[22] Filed: Feb. 5, 1988

[30] Foreign Application Priority Data

Feb. 5, 1987 [DE] Fed. Rep. of Germany ..... 3703514

[51] Int. Cl.[4] ..... B04B 5/02

[52] U.S. Cl. ..... 494/16

[58] Field of Search ..... 494/16, 17, 18, 19, 494/20, 21, 45; 422/72

[56] References Cited

U.S. PATENT DOCUMENTS 3,825,178 7/1974 Burg ..... 494/16
4,449,965 5/1984 Strain ..... 494/16
4,484,906 11/1984 Strain ..... 494/16
4,553,955 11/1985 Lam ..... 494/16

*Primary Examiner*—Robert W. Jenkins
*Attorney, Agent, or Firm*—Browdy and Neimark

[57] ABSTRACT

An angular cap for a centrifuge, in which test tubes containing material to be centrifuged are disposed in vertically inclined holders, the cap having a hub adapted to be mounted on a motor shaft of the centrifuge, said cap including a vertically inclined, continuous annular groove extending along the circumference of the cap and a plurality of breaker-like vertically inclined inserts adapted to be positioned in the annular groove disposed in a row for holding the test tubes, the breaker-like inserts each having protrusions disposed on the outside of an upper part of the insert, facing one another, which when the inserts are dipsosed in a row in the annular groove produce a continuous, smooth, annular surface.

10 Claims, 3 Drawing Sheets

FIG 6
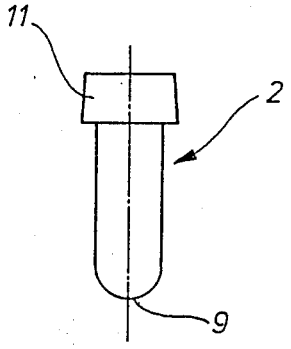
FIG 7
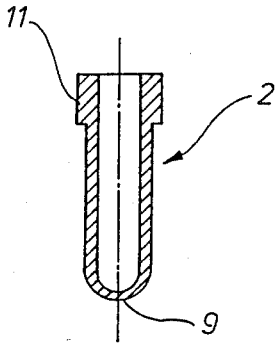
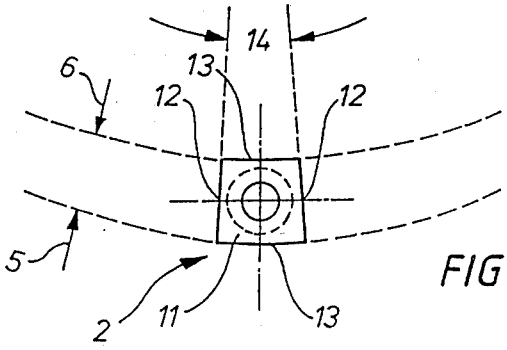
FIG 8

FIG 9
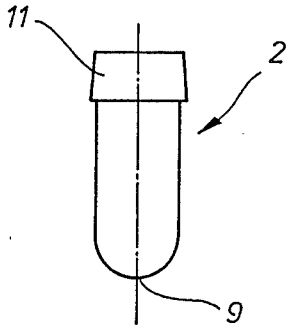
FIG 10
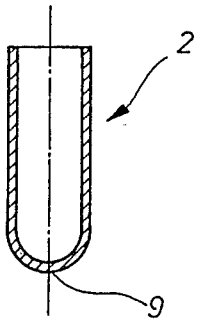
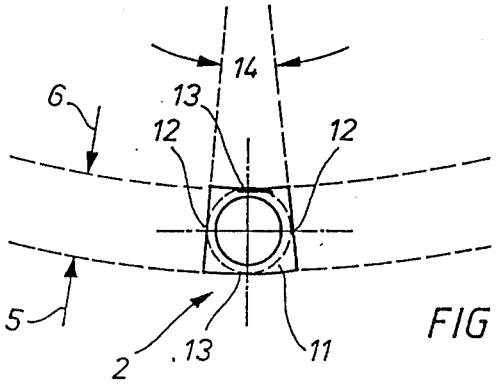
FIG 11

ANGULAR CAP FOR CENTRIFUGES

FIELD OF THE INVENTION

The present invention relates to an angular cap for centrifuges, in which the test tubes containing the material to be centrifuged are disposed in vertically inclined holders. With its hub, the cap is mounted on the motor shaft of the centrifuge. Beaker-like vertically inclined inserts are disposed in a row in a continuous, vertically inclined annular groove on the circumference of the cap.

BACKGROUND OF THE INVENTION

In an angular cap known from U.S. Pat. No. 4,553,955, the vertically inclined holders are in the form of bores distributed about the circumference of the angular cap, and adapters are introduced into the holders. Each test tube containing the material to be centrifuged is inserted into a respective adapter. The provision of the individual bores in particular makes this type of known angular cap very expensive and labor-intensive to manufacture. To hold 24 test tubes, for example, 24 bores must correspondingly be provided at the circumference of the angular cap, which is relatively time consuming and tedious work, because the bores must be made precisely symmetrical to one another to prevent the danger of an out-of-round operation during centrifuging.

SUMMARY OF THE INVENTION

The object of the present invention is to improve an angular cap of the above generic type such that it is substantially easier and less expensive to manufacture, and that it is suitable for holding a variably large number of test tubes.

This object is attained by providing that a plurality of protrusions, facing one another, are located on the outside of the upper part of the beaker-like inserts. When the inserts are placed in a row in the annular groove, the result is a continuous smooth, annular surface.

The essence of the invention is that a vertically inclined hollow space in the form of an annular groove is provided in the angular cap, and this annular groove is filled with beaker-like inserts for holding test tubes. If fewer test tubes are needed, the empty spaces can either be filled with dummy inserts, or simply remain empty.

It is relatively simple and inexpensive to produce a continuous annular groove of this kind. This annular groove can be made with very great precision, and the angular cap is easy to make as a turned part with its top and bottom adapted to one another.

The manufacturing of individual, labor-intensive bores can thus be dispensed with.

In a further feature of the invention, the bottom portion of the continuous annular groove is rounded, and the beaker-like inserts are made of plastic or rigid expanded material. On the outside of the bottom portion of the inserts have the same kind of rounded surface as the annular groove. As a result, the beaker-like inserts rest flush with the annular groove and are readily able to withstand the considerable centrifugal force that prevails during centrifuging of the test tubes.

The beaker-like inserts advantageously have square protrusions on the outside of their upper portions which on the one hand, rest with complementary rounded surfaces on the inner and outer radial extension of the annular groove, and on the other, rest flush on one another with rectilinearly extending surfaces that extend conically toward the center of the centrifuge.

Filling the annular groove with all the beaker-like inserts produces a seamless annular surface, made up of the tops of the inserts, along the opening of the annular groove. This smooth surface precludes mutual displacement of the test tubes to be inserted later.

Advantageously, two opposed ribs can be provided in the bottom part of the beaker-like inserts, along the outside thereof, thus reducing the inside diameter of the inserts. These ribs contribute to an advantageous linear distribution of load in the vertical direction inside the annular groove and, by spread-ing slightly, secure the inserts against filling out. The ribs may also be offset by 90° alongside the inserts, to provide reinforcement in the plane of the annular groove.

Additional advantageous features of the invention are disclosed in the dependent claims.

Further advantageous embodiments of the invention will now become apparent from the ensuing detailed description taken in conjunction with the drawing.

BRIEF DESCRIPTION OF THE DRAWINGS

FIG. 6 is a view of a beaker-like insert with continuous square protrusions in the top part and having a longitudinal extension of reduced diameter;

FIG. 7 is a sectional view taken along the longitudinal axis of FIG. 6;

FIG. 8 is an end view of the insert of FIG. 6;

FIG. 9 is a view of a beaker-like insert having protrusions of reduced size in the top part and of larger diameter in the longitudinal extension;

FIG. 10 is a sectional view taken along the longitudinal axis of an insert of FIG. 9; and FIG. 11 is an end view of the insert of FIG. 9.

DESCRIPTION OF THE PREFERRED EMBODIMENTS

Figures 1, 2, 3, 4, 5:
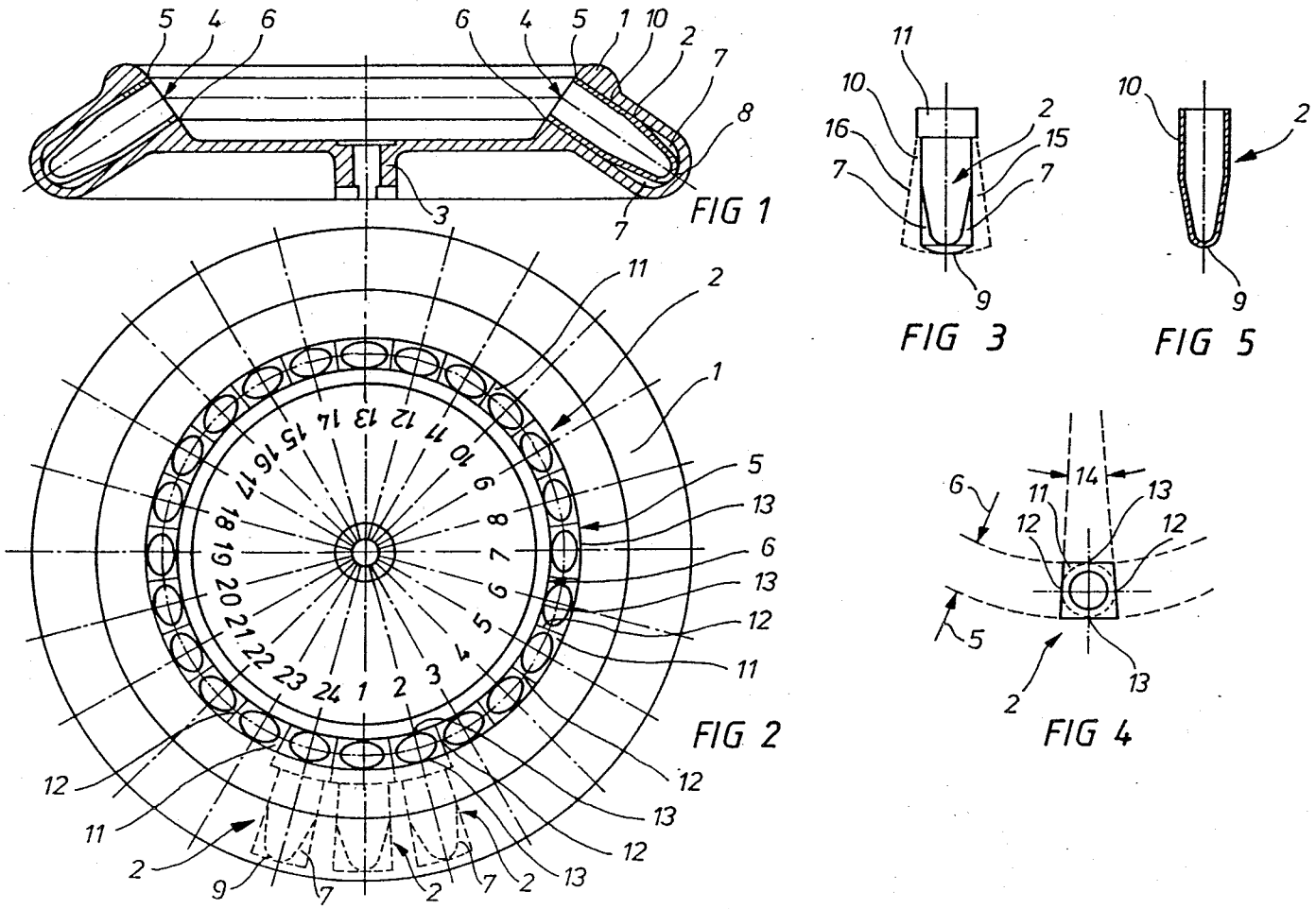
FIG. 1 is a section through an angular cap according to the invention, with beaker-like inserts introduced into the annular groove, and having reinforcement ribs extending vertically.
FIG. 2 is a plan view of an angular cap according to FIG. 1 with inserts, having reinforcement ribs extending in the plane of the annular groove.
FIG. 3 is a view of a beaker-like insert having reinforcement or support ribs in the bottom part.
FIG. 4 is an end view of a beaker-like insert according to FIG. 3.
FIG. 5 is a sectional view of the beaker-like insert of FIG. 3 taken along the longitudinal axis.

FIG. 1 shows the angular cap 1 of light metal, with a continuous annular groove 4, inclined with respect to the vertical, milled into it. The angular cap 1 has a hub 3, which for a centrifuging operation, is mounted on the motor shaft of a centrifuge, not shown here. As shown in FIG. 1, the beaker-like inserts 2 having vertical support ribs are introduced into the continuous annular groove 4.

FIG. 2 shows that the placement of all the beaker-like inserts 2 in a row produces a seamless circular annular surface having the outer radius 5 and the inner radius 6. Here, horizontal support ribs 7 are provided, located adjacent one another. FIG. 1 shows that the annular groove 4 is rounded in its bottom part 8.

In its bottom part, the beaker-like insert 2 shown in FIG. 3 also has rounded surfaces 9, with which it is braced on the bottom part 8 of the annular groove 4. In the vicinity of the longitudinal axis, the beaker-like insert 2 of FIG. 3 extends conically in the lower part, where the now-reduced diameter of the insert 2 is provided with reinforcement or support ribs 7 extending alongside it. As shown in FIG. 2, the ribs 7 are located beside one another in the inclined plane of the annular groove 4. However, the support ribs 7 can also be offset by 90° in FIG. 3, disposed alongside the beaker-like insert 2, thereby providing support in the vertical direction. As a result, as shown in FIG. 1, the annular groove 4 is completely filled in the vertical direction, and the beaker-like insert 2 is firmly seated in the annular groove 4, possibly spreading slightly.

As a result, contact between the insert 2 and annular groove 4 is attained not only on the bottom in the annular groove 4 and laterally in a linear manner along the reinforcement ribs 7 of FIG. 1, but also in the vicinity of the neck 10, and additionally in the upper part, on the four-cornered protrusions 11 of FIG. 2.

The protrusion 11 is embodied such that as shown in FIGS. 4, 8 and 11, two rectilinearly extending faces 12 rest flush against one another, as shown in FIG. 2, when the inserts 2 are placed in a row, and two further rounded faces 13 rest flush on the outer radius 5 and inner radius 6, respectively, of the annular groove 4. In the annular range 14, the faces 12 of the inserts 2 extend conically toward the center of the angular cap 1 (see FIGS. 4, 8 and 11).

From FIGS. 3, 4 and 9, 11, taken in conjunction with FIGS. 5 and 10, it is apparent that the protrusion 11 consists only of the rectilinearly extending face 12, on which the beaker-like inserts 2 rest flush against one another in the annular groove 4 as shown in FIG. 2. In the vicinity of the radii 5, 6, the inserts 2 of FIGS. 1, 5 and 10 do not have any pronounced protrusions 11, but instead the circumferential surface of the upper parts of inserts 2 rest against the annular groove 4 as seen in FIG. 1. Accordingly, the longitudinal course of the inserts 2 of FIGS. 5 and 10 is also designed such that the annular groove 4 of FIG. 1 is filled up in the linear direction.

In another embodiment shown in FIGS. 6, 7 and 8 an insert 2 is provided which has four-concerned protrusions 11 in the upper part thereof, which are unitary or connected with longitudinal extension of the inserts 2 having a reduced diameter with respect to the protrusion 11. As a result, contact at the bottom on the rounded surface 9 is provided only in the annular groove 4, while in the vicinity of the protrusion 11 the inserts rest against the inside of the cap. This can have advantages in terms of the mutual alignment of the inserts, or in terms of making them easier to replace.

Hence, according to the invention, inserts 2 are provided that either rest positively in the annular groove 4 with reinforcement ribs 7, as in FIGS. 1 and 3, and along their longitudinal axis fill up the annular groove 4 completely, as in FIG. 10, or are only partly in contact with the inside of the annular groove 4, as is the case for instance with an insert of the kind shown in FIG. 7. It is also possible to provide inserts 2 which, because they have an enlarged diameter or because they have ribs extending transversely or longitudinally over part or all of the circumference of the inserts, spread firmly into place upon being introduced into the annular groove 4.

It is also provided according to the invention that the inserts 2 are not introduced individually into the annular groove 4, but that instead, via injection molded plastic parts such as strips or webs, the inserts 2 are paired, or joined together in sets having a larger number of inserts, along the protrusions 11 and then introduced into or pressed into the annular groove 4. To this end, the inserts 2 can be pushed evenly on into the annular groove 4 with a conelike tool.

According to FIG. 2, twenty-four inserts 2 are provided in order to fill up the annular groove 4 completely. Fewer inserts 2 can also be used, and the empty sites that remain can be filled with dummy inserts.

Lateral sliding elements can also be provided extending along the outside in the direction of the continuous annular groove 4, so that either the inserts 2 and these elements rest on one another, or the inserts 2 mesh with them on the outside, in the manner of a tongue-and-groove guide provided alongside.

To this end, it is provided in accordance with FIG. 3 that a groove 15 is provided alongside the insert 2 as shown, the groove being associated with a corresponding tongue 16 facing it. When the inserts 2 are introduced into the annular groove 4, the inserts 3 rest flush against one another in a tongue-and-groove engagement, in order to provide greater stability of the inserts 2 in the plane of the annular groove 4.

The foregoing description of the specific embodiments will so fully reveal the general nature of the invention that others can, by applying current knowledge, readily modify and/or adapt for various applications such specific embodiments without adaptations and modifications should and are intended to be comprehended within the meaning and range of equivalents of the disclosed embodiments. It is to be understood that the phraseology or terminology employed herein is for the purpose of description and not of limitation.

What is claimed is:

1. An angular cap for a centrifuge, in which test tubes containing material to be centrifuged are disposed in vertically inclined holders, the cap having a hub adapted to be mounted on a motor shaft of the centrifuge, said cap comprising:

a vertically inclined, continuous annular groove extending along the circumference of the cap; and a plurality of beaker-like vertically inclined inserts adapted to be positioned in said annular groove disposed in a row for holding the test tubes, said beaker-like inserts each having protrusions disposed on the outside of an upper part of the insert, facing one another, which when said inserts are disposed in a row in said annular groove produce a continuous, smooth, annular surface.

2. An angular cap as defined by claim 1, wherein said protrusions comprise four-cornered protrusions disposed on the outside of the inserts, wherein two opposed faces have radial rounded surfaces for contact in said annular groove, and the other two opposed faces extend rectilinearly toward the center of the angular cap for providing mutual contact between adjacent inserts.

3. An angular cap as defined by claim 1, wherein said beaker-like inserts have a conically rounded surface in the longitudinal direction and two opposed support ribs are provided extending alongside of the insert in the region of the conically rounded surface on the outside of said inserts.

4. An angular cap as defined by claim 1, wherein said continuous annular groove is rounded in its bottom part.

5. An annular cap as defined by claim 4, wherein said beaker-like inserts have a rounded surface on the outside in their bottom parts, complementary to the rounded bottom part of said annular groove.

6. An angular cap as defined by claim 1, wherein the upper parts of said beaker-like inserts, rest with protrusions against one another and against said annular groove and lower portions of said inserts have a diameter that is smaller than the diameter of said annular groove.

7. An angular cap as defined by claim 1, wherein said beaker-like inserts, with their outer parts, fill up said annular groove.

8. An angular cap as defined by 1, wherein said continuous annular groove of the angular cap has, in alternate symmetrical succession, said beaker-like inserts and inserts for empty sites.

9. An angular cap as defined by claim 1, wherein at least two of said beaker-like inserts are joined together to form sets via injection molded plastic parts.

10. An angular cap as defined by claim 1, wherein the bottom part of said beaker-like inserts have a slightly increased diameter and spread laterally in the bottom part of said annular groove.

* * * * *